US005310004A

United States Patent [19]

Leismer

[11] Patent Number: 5,310,004

[45] Date of Patent: May 10, 1994

[54] FAIL SAFE GAS BIAS SAFETY VALVE

[75] Inventor: Dwayne D. Leismer, Pearland, Tex.

[73] Assignee: Camco International Inc., Houston, Tex.

[21] Appl. No.: 3,922

[22] Filed: Jan. 13, 1993

[51] Int. Cl.[5] ..... E21B 34/10

[52] U.S. Cl. ..... 166/321

[58] Field of Search ..... 166/321, 319, 322, 323, 166/373, 374

[56] References Cited

U.S. PATENT DOCUMENTS

| | | | |
|---|---|---|---|
| 3,794,112 | 2/1974 | Hill | 166/321 |
| 3,826,309 | 7/1974 | Tausch | 166/319 |
| 3,850,238 | 11/1974 | Hill | 166/374 |
| 4,252,197 | 2/1981 | Pringle | 166/322 |
| 4,373,587 | 2/1983 | Pringle | 166/324 |
| 4,376,464 | 3/1983 | Crow | 166/324 |
| 4,598,773 | 7/1986 | Pringle | 166/373 |
| 4,660,646 | 4/1987 | Blizzard | 166/321 |
| 4,676,307 | 6/1987 | Pringle | 166/322 |
| 4,976,317 | 12/1990 | Leismer | 166/321 |
| 4,986,357 | 1/1991 | Pringle | 166/319 |
| 5,167,284 | 12/1992 | Leismer | 166/374 |

*Primary Examiner*—Ramon S. Britts
*Assistant Examiner*—Frank S. Tsay
*Attorney, Agent, or Firm*—Fulbright & Jaworski

[57] ABSTRACT

A subsurface well safety valve having a flow tube telescopically movable in the housing for controlling movement of a valve closure member. A piston and cylinder assembly actuates the flow tube and it is in communication with hydraulic control fluid on one side and a gas biasing chamber on a second side and includes a biasing spring acting on the flow tube to close the valve. A second piston is telescopically positioned in the first piston with two different sized sealing areas, one of which is exposed to hydraulic fluid and the second of which is exposed to the gas chamber. In the event of loss of gas pressure, the second piston will separate from the first piston causing hydraulic pressure equalization and failsafe closure of the valve.

6 Claims, 5 Drawing Sheets

FAIL SAFE GAS BIAS SAFETY VALVE

BACKGROUND OF THE INVENTION

It is known to use a subsurface safety valve which is actuated to the open position by the application of hydraulic fluid from the well surface and which is moved to the closed position by biasing means such as an enclosed pressure gas chamber and a mechanical spring.

It is imperative that a safety valve must close under all circumstances and if there is a failure it must be failsafe in a closed position. As valves are set deeper in the well, pressurized chambers having compressed gas are used as a biasing force in addition to a biasing spring. U.S. Pat. Nos. 4,660,646 and 4,976,317 disclose gas biased safety valves which allow a valve to failsafe close if the gas charge is lost.

The prior failsafe gas safety valves included numerous parts and seals. The present invention is directed to a minimum number of parts and seals and this reduction will reduce manufacturing cost, decrease friction, reduce assembly time, and improve reliability. In addition, the present improved safety valve will overcome other problems associated with prior art valves.

SUMMARY

The present invention is directed to a subsurface well safety valve for controlling the fluid flow through a well conduit and includes a housing having a bore and a valve closure member moving between open and closed positions for controlling the fluid flow through the bore. A flow tube is telescopically moving in the housing for controlling the movement of the valve closure member. A hydraulic piston and cylinder assembly in the housing engages and moves the flow tube and includes a first side adapted to be in communication with a control fluid at the well surface and a gas chamber in the housing is in communication with the second side of the assembly acting on the assembly in a direction to close the valve. In addition, spring means are provided between the housing and the flow tube acting on the flow tube in a direction to close the valve. The valve includes an improvement for failsafe closing of the safety valve in the event of a loss of gas pressure and includes a second piston telescopically positioned in the first piston. First and second different sized seals are provided between the second and first piston. The first piston includes a hydraulic passageway extending from the first side of the assembly to the second piston at the smaller seal. The larger seal is exposed to the gas chamber whereby on a loss of gas pressure, the second piston will move relative to the first piston in response to the hydraulic fluid and equalize hydraulic pressure across the first piston allowing the biasing spring to close the valve.

Still a further object of the present invention is wherein the assembly includes a seal assembly between the piston and cylinder which includes first and second spaced seals. In the preferred embodiment the spaced seals each include an elastomer seal and a non-elastomer spring energized seal.

Yet a still further object of the present invention is the provision of a third seal between the piston and cylinder and positioned below the first and second seals.

Yet a still further object of the present invention is the provision of a second hydraulic fluid passageway extending from the first hydraulic fluid passageway to a point above the third seal.

A still further object of the present invention is the provision of a second piston telescopically positioned in an end of the first piston in which the second piston has first and second ends. The second end has a larger cross-sectional area than the first end and the first and second ends each sealably engage the first piston. The first piston includes a hydraulic fluid passageway extending from the first side of the assembly to the first end of the second piston and the second end of the second piston is exposed to the gas chamber for normally holding the second piston in the first piston. Upon a loss of gas pressure the second piston will move relative to the first piston in response to the hydraulic fluid and equalize hydraulic pressure across the first piston.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

While the present invention and the subsurface well safety valve will be described, for purposes of illustration only, as incorporated in a flapper type tubing retrievable safety valve, it will be understood that the present invention may be used with other types of safety valves and safety valves having various types of valve closure elements.

Figure 1A:
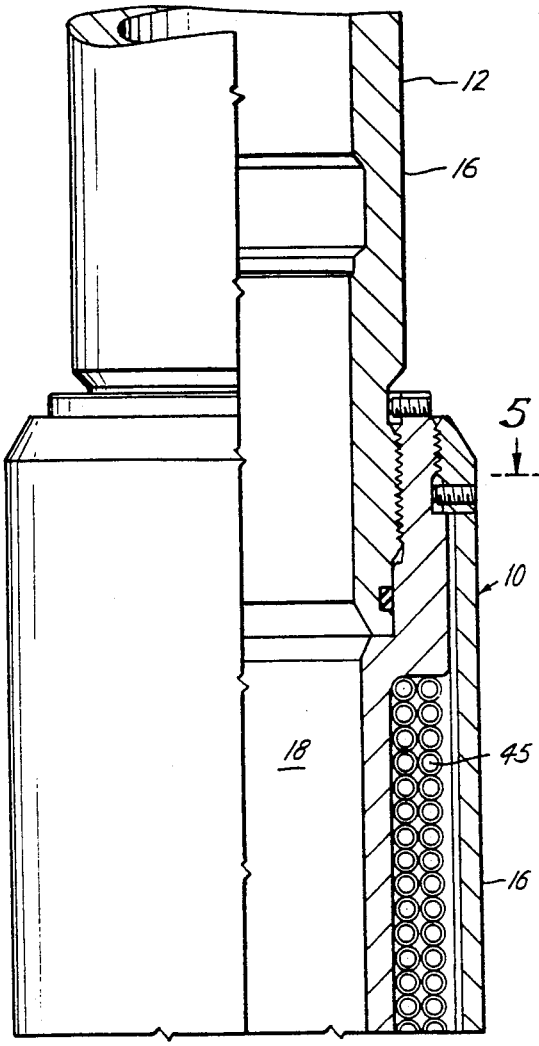
FIGS. 1A, 1B, 1C, 1D, 1E, and 1F are continuations of each other and are in elevational view, in quarter section of the safety valve of the present invention shown in the open position.
Figure 1B:
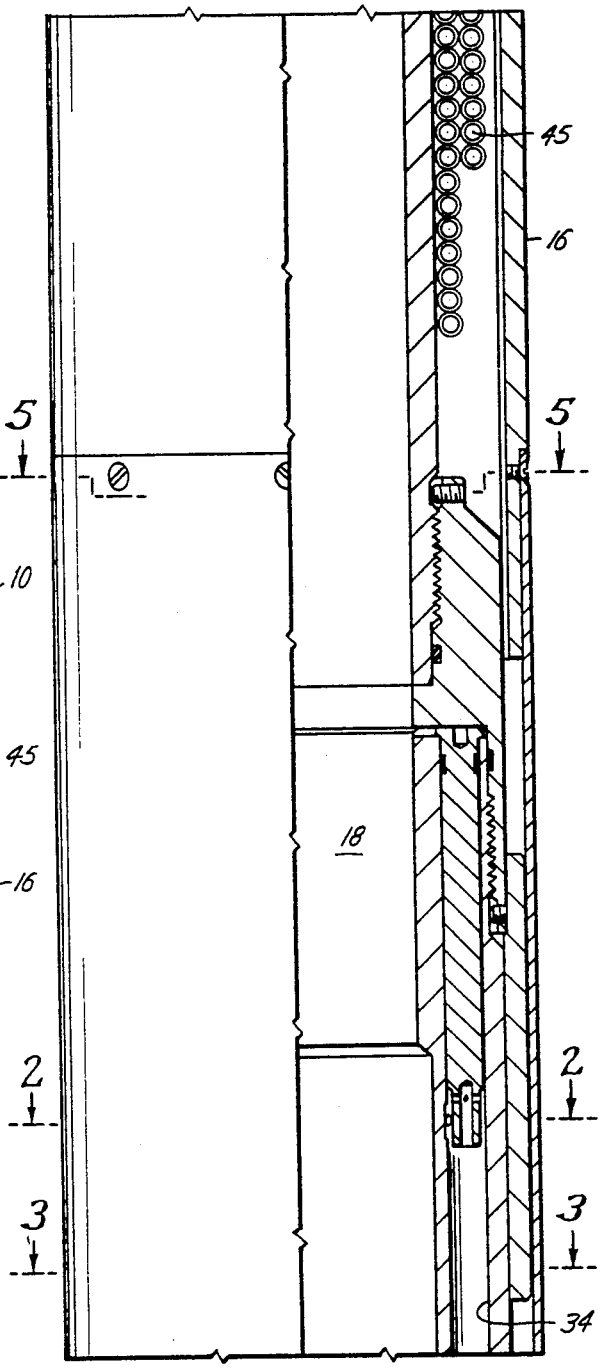
Figure 1C:
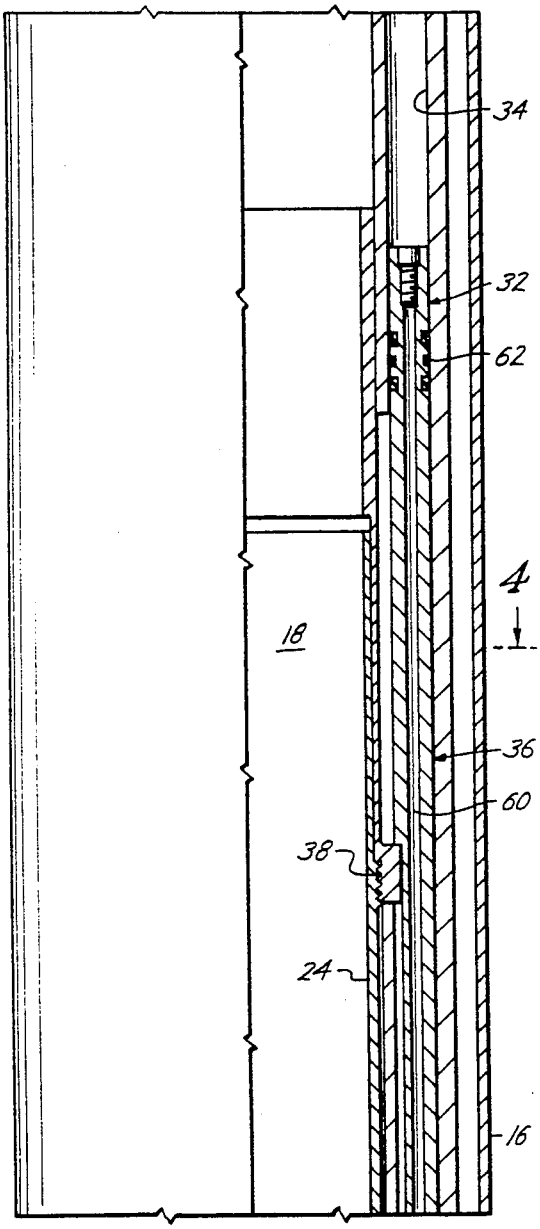
Figure 1D:
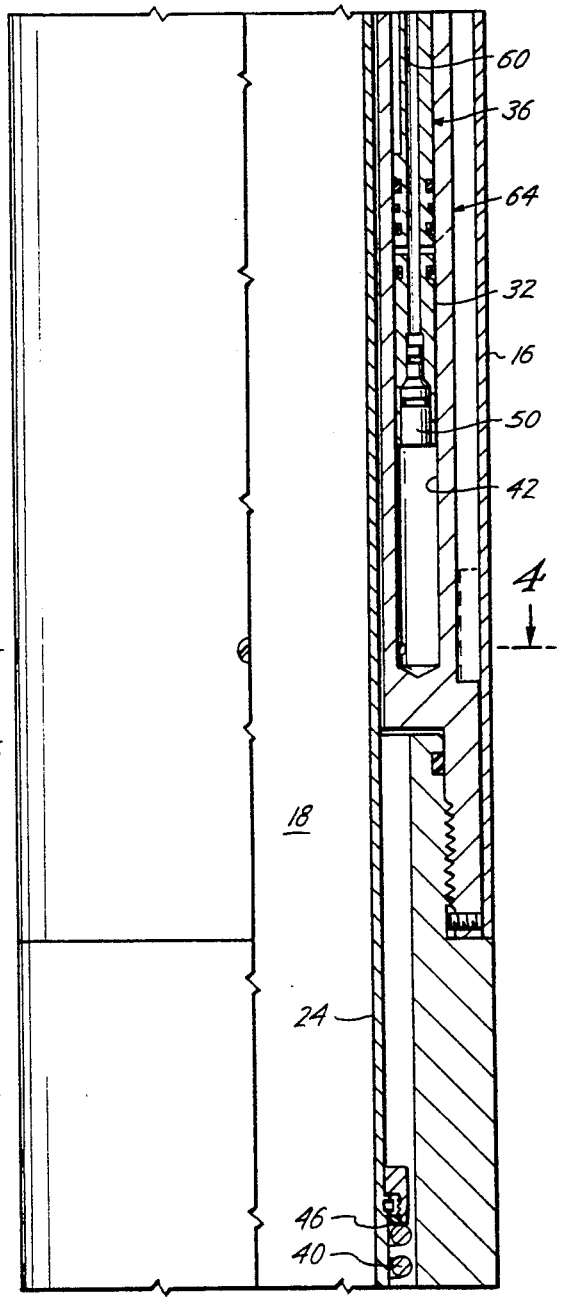
Figure 1E:
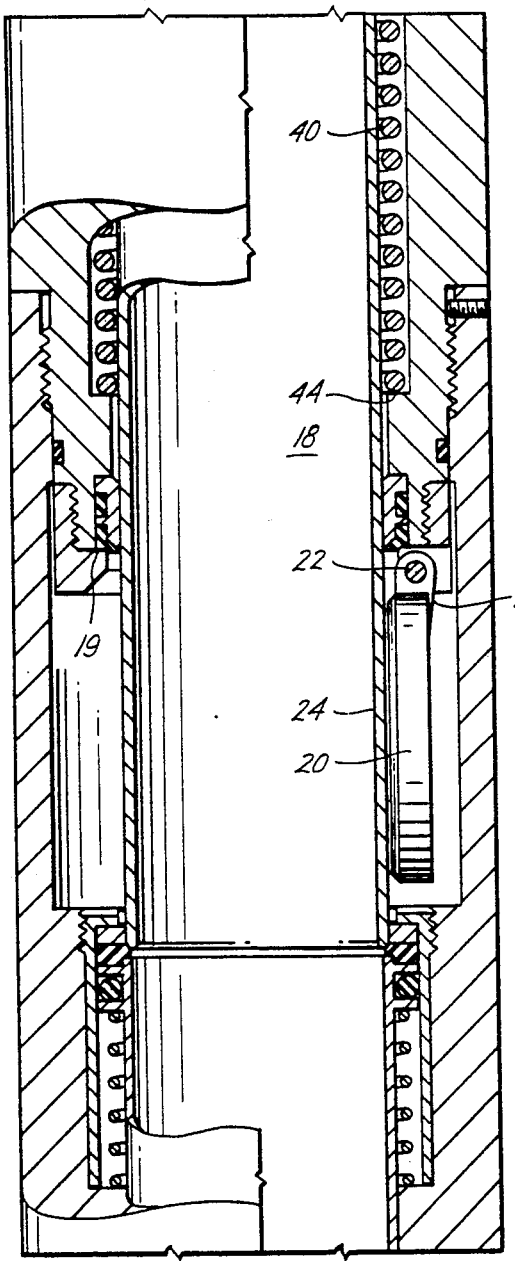
Figure 1F:
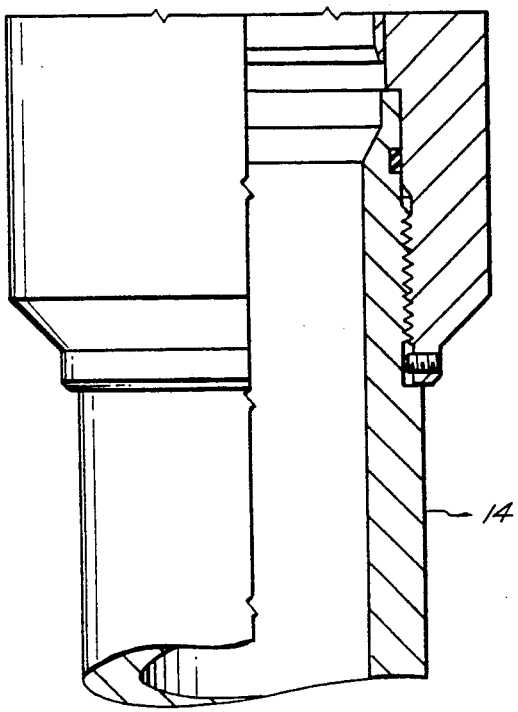

Referring now to the drawings, and particularly to FIGS. 1A through 1F, the subsurface safety valve of the present invention is generally indicated by the reference numeral 10 having a top 12 and a bottom 14 for connection in a well tubing such as by threaded connections (not shown). The valve 10 generally includes a body or housing 16 adapted to be connected to a well tubing to form a part thereof and to permit well production therethrough under normal operating conditions, but in which the safety valve 10 may close or be closed when desired, or in response to abnormal conditions. The valve 10 includes a bore 18 and as best seen in FIG. 1E, an annular valve seal 19 positioned above the bore 18, a valve closure element or flapper valve 20, connected to the body 16 by pivot pin 22. When the valve closure member 20 is in the upper position and seated on the valve seat 19, the safety valve is closed, blocking flow upwardly through the bore 18 and the well tubing.

A tubular member or flow tube 24 is telescopically movable in the body 16 and through the valve seat 19. When the flow tube 24 is moved to a downward position, the tube 24 pushes the flapper 20 away from the valve seat. Thus, the valve 10 is held in the open position so long as the flow tube 24 is in the downward position. When the flow tube 24 is moved upwardly, the flapper valve 20 is allowed to move upwardly on to the seat 19 by the action of a spring 26.

Figure 2:
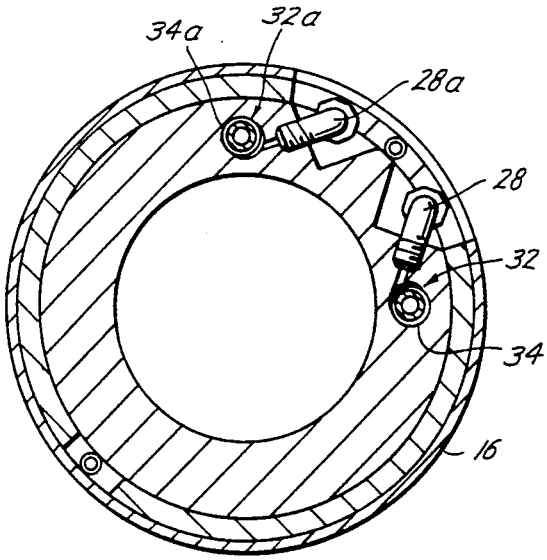
FIG. 2 is a cross-sectional view taken along the line 2—2 of FIG. 1B.
Figure 3:
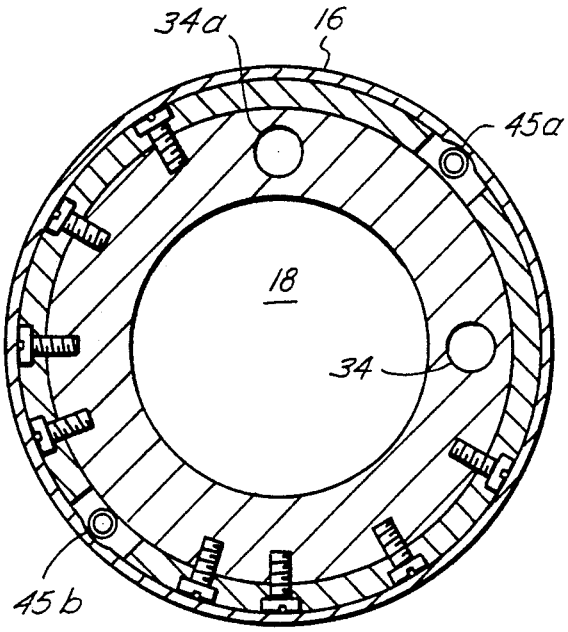
FIG. 3 is a cross-sectional view taken along the line 3—3 of FIG. 1B.
Figure 4:
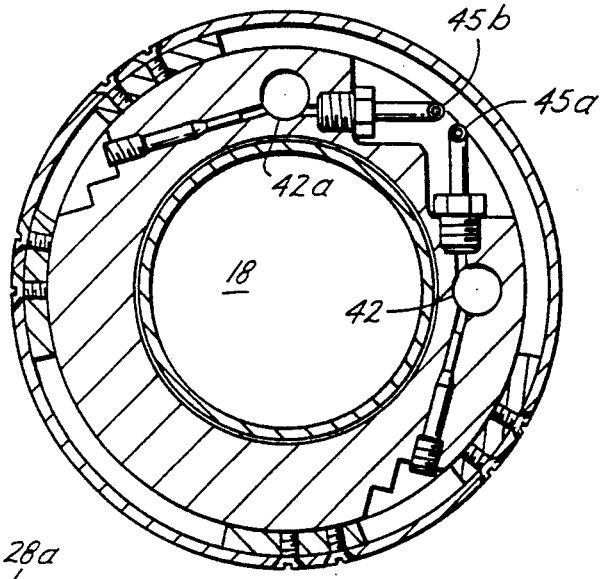
FIG. 4 is a cross-sectional view taken along the line 4—4 of FIG. 1D.
Figure 5:
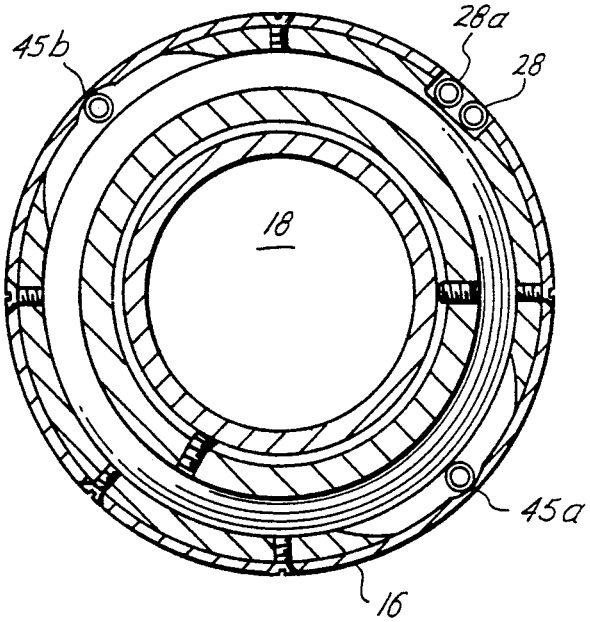
FIG. 5 is a cross-sectional view taken along the line 5—5 of FIG. 1B, FIGS. 6A and 6B are continuations of each other, and form an enlarged cross-sectional view of the piston of the present invention.
Figure 6A:
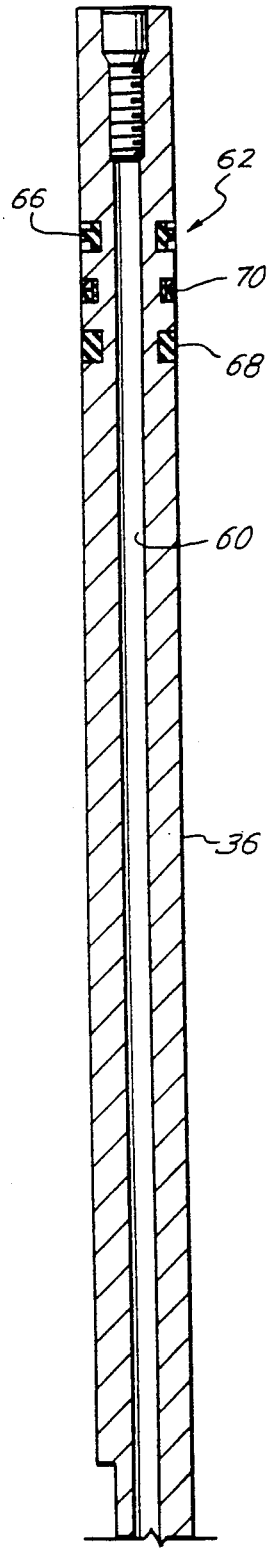
Figure 6B:
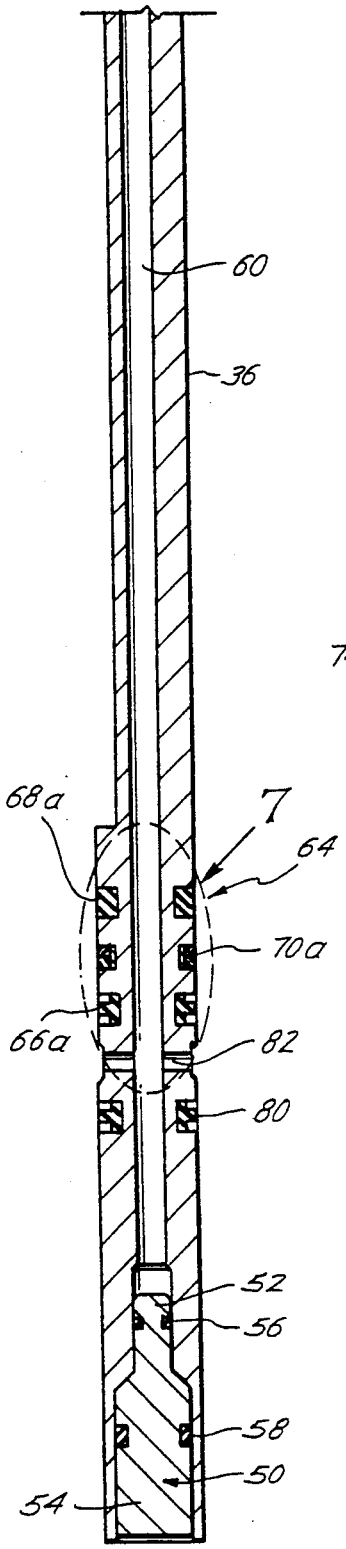

The safety valve 10 is controlled by the application or removal of a pressurized fluid, such as hydraulic fluid, through a control path or line, such as one or more control lines 28 and 28*a*, which extend to the well surface or the casing annulus, to supply a pressurized hydraulic fluid to the top of one or more piston and cylinder assemblies, here shown as assemblies 32 and 32*a* (FIGS. 2, 1C, 1D, respectively) which generally includes a cylinder indicated by reference numeral 34 and 34*a*, respectively, and a piston system generally indicated by the reference numeral 36 and 36*a* (not shown). Only one of the piston and cylinder assemblies, such as 32, are fully shown and will be described, while the other assembly 32*a* is identical. One of the pistons 36 and cylinder 34 is connected to the flow tube 24, such as piston 36, by a connection 38. Therefore, the application of pressurized hydraulic fluid to the top or first side of the piston and cylinder assembly 32 will move the flow tube 24 downwardly forcing the flapper valve element 20 off of the seat 19. Biasing means, such as a spring 40 (FIGS. 1D and 1E) and a pressurized gas chamber 42 (FIG. 1D) are provided for yieldably urging the flow tube 24 upwardly in a direction to release the flapper valve element 20 for closing the valve 10. The spring 40 acts between a shoulder 44 on the housing 16 and a shoulder 46 on the flow tube 24. The pressurized gas chamber 42 may include a plurality of tubing coils (FIGS. 1A, 1B) containing pressurized nitrogen which extend through lines 45*a* and 45*b* (FIG. 4) to gas chambers 42 and 42*a*, respectively, of the assemblies 32 and 32*a*, respectively, which preferably include a silicone fluid.

However, subsurface safety valves which, in the past, have relied upon compressed gas for valve closure, lack efficient means by which the valve closure is substantially fail proof. That is, if the seals holding the pressurized gas fail, then the gas will leak out and fail to provide the closing force when necessary.

The present invention provides a failsafe piston 36 consisting of a minimum of parts and seals which reduce manufacturing costs, decrease friction, reduce assembly time, and improve failsafe reliability. The failsafe piston 36 of the present invention is best seen in FIGS. 1C, 1D, 6A, 6B and 7. The piston 36 includes a second piston 50 telescopically positioned in an end of the first piston 36. The second piston 50 has a first end 52 and a second end 54. The second end 54 has a larger cross-sectional area than the first end 52. The first and second ends are each sealably engaging the first piston 36 by seals 56 and 58, respectively. The seal 56 seals a smaller cross-sectional area than the larger seal 58. The first piston 36 includes a hydraulic fluid passageway 60 extending from the first side of the hydraulic piston and cylinder assembly 32 to the first end 52 of the second piston 50 and acts against the seal 56. The second end 54 of the second piston 50 is exposed to the gas pressure in the chamber 42. Since the cross-sectional area of the second end 54 of the piston 50 has a seal area 58 larger than the seal area 56 of the first end 52, the second piston 52 will remain in engagement in the end of the first piston 36 with a lower gas pressure acting on the end 54 as compared with the hydraulic fluid pressure acting on the end 52. However, as will be more fully described hereinafter, if the gas pressure is lost, and is therefore unable to overcome hydrostatic head of the hydraulic fluid acting on the piston 36, the force of the gas pressure acting on the second end 54 of the piston 50 decreases allowing the hydrostatic pressure of the hydraulic fluid acting on the first end 52 to push the second piston 50 out of the piston 36 thereby balancing the hydrostatic control fluid forces on the piston 36 whereby the biasing spring 40 may close the safety valve 10.

Figure 7:
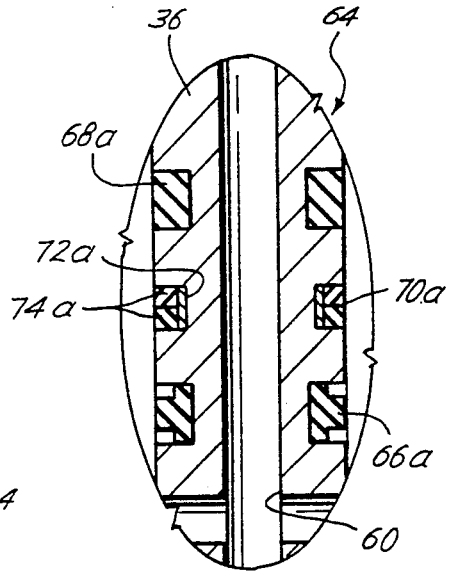
FIG. 7 is an enlarged cross-sectional view of the dotted and circled seal area of FIG. 6B.

Obviously, suitable seal means must be provided between the piston 36 and the cylinder 34 in the assembly 32. While in various applications, a single seal may be satisfactory, in the present invention an upper seal system 62 and a lower seal system 64 is provided spaced from each other. Each of the seal systems 62 and 64 are exposed on one side to the tubing pressure in the bore 18 (around the unsealted flow tube 24) so as to compensate for the effects of tubing pressure on the piston 36. Preferably, each of the seal systems 62 and 64 consists of a dynamic seal 66 and 66*a*, respectively, which may be a conventional elastomer T-seal, a debris barrier 68 and 68*a*, respectively, and a non-elastomer spring energized seal 70 and 70*a*, respectively. As best seen in FIG. 7, the seal 70*a* consists of a spring 72*a*, and two plastic seals 74*a*. The seals 70 and 70*a*, while not fluid tight, are sufficient to provide normal valve closure in the event of failure of the elastomeric seals 66 and 66*a*.

Preferably, a third seal 80, such as a conventional elastomer T-seal, is provided on the piston 36 positioned below the first and second seal systems 62 and 64. Also, a second hydraulic fluid passageway 82 is provided which extends from the first hydraulic fluid passageway 60 to a point above the third seal 80 and between the third seal 80 and the seal means 64. The passageway 82 provides hydraulic fluid for lubricating the seals 66*a* and 80 and reducing any pressure differential between the seals 66*a* and 80, which adds to their life.

In operation, the valve 10 is normally actuated by the application and reduction of the pressure of hydraulic control fluid on the first or upper side of the piston and cylinder assembly 32 (and/or assembly 32*a*). The gas charge acting on the second end 54 of the second piston 50 maintains the position of the second piston 50 in the lower end of the piston 36. Also, the normal gas charge is sufficient to lift (with spring 40) the hydrostatic fluid column acting on the piston 66 when the pressurized hydraulic fluid is removed from the assembly 32 and close the valve 10.

If the gas charge in the chamber 42 leaks past the lower seal 80, the hydraulic control fluid in the passageway 60 will also be transmitted through the second hydraulic passageway 82 past the seal 80 and act on the second end 54 of the second piston 50 to equalize the hydrostatic head acting on the piston 36. This will allow the biasing spring 40 to close the safety valve 10 even in the absence of gas pressure.

In the event that the nitrogen gas charge is lost from the chamber 42 through a failure in the chamber or the coils 45, the force of the hydraulic fluid acting through passageway 60 on the small end 52 of the piston 50 and against the smaller seal 56 will provide a greater force than the force of the gas charge acting up on the larger second end 54 of the second piston 50. Thus, the lower piston will be moved downwardly and separate from the piston 36 allowing the hydraulic fluid in the passageway 60 to again equalize on the piston 36. Again, in this case, the biasing spring 40 will move the safety valve to the failsafe closed position.

The present invention, therefore, is well adapted to carry out the objects and attain the ends and advantages mentioned as well as others inherent therein. While a presently preferred embodiment of the invention has been given for the purpose of disclosure, numerous changes in the details of construction, and arrangement of parts will be readily apparent to those skilled in the art and which are encompassed within the spirit of the invention and the scope of the appended claims.

What is claimed is:

1. In a subsurface well safety valve for controlling the fluid flow through a well conduit and including a housing having a bore and a valve closure member moving between open and closed positions for controlling the fluid flow through the bore, a flow tube telescopically moving in the housing for controlling the movement of the valve closure member, a first hydraulic piston and cylinder assembly in the housing engaging and moving the flow tube and having first and second sides, the first side of the assembly adapted to be in communication with control fluid at the well surface, and a gas chamber in the housing in communication with the second side of the assembly acting on the assembly in a direction to close said valve, and spring means between the housing and the flow tube acting on the flow tube in a direction to close said valve, the improvement in means for failsafe closing of the safety valve in event of a loss of gas pressure comprising, a second piston telescopically positioned in the first piston, a first small seal and a second larger seal between the second and the first piston, said first piston having a hydraulic fluid passageway extending from the first side of the assembly to the second piston at the smaller seal, and said larger seal being exposed to the gas chamber whereby on a loss of gas pressure the second piston will move relative to the first piston in response to the hydraulic fluid and equalize hydraulic pressure across the first piston.

2. The valve of claim 1 including a seal system between the first piston and cylinder comprising, first and second spaced seals.

3. The valve of claim 2 wherein the spaced seals each include an elastomeric seal and a non-elastomeric spring energized seal.

4. The valve of claim 2 including a third seal between the piston and cylinder and positioned below the first and second seals.

5. The valve of claim 4 including, a second hydraulic fluid passageway extending from the first hydraulic fluid passageway to a point above the third seal.

6. In a subsurface well safety valve for controlling the fluid flow through a well conduit and including a housing having a bore and a valve closure member moving between open and closed positions for controlling the fluid flow through the bore, a flow tube telescopically moving in the housing for controlling the movement of the valve closure member, a first hydraulic piston and cylinder assembly in the housing engaging and moving the flow tube, the first side of the assembly adapted to be in communication with control fluid at the well surface, and a gas chamber in the housing in communication with the second side of the assembly acting on the assembly in a direction to close said valve, and spring means between the housing and the flow tube acting on the flow tube in a direction to close said valve, the improvement in means for failsafe closing of the safety valve in event of a loss of gas pressure comprising, a second piston telescopically positioned in an end of the first piston, said second piston having first and second ends, the second end having a larger cross-sectional area than the first end, said first and second ends each sealably engaging the first piston, said first piston having a hydraulic fluid passageway extending from the first side of the assembly to the first end of the second piston, said second end of the second piston exposed to the gas chamber.

* * * * *